United States Patent [19]

Blaisdell

[11] Patent Number: 5,065,165

[45] Date of Patent: Nov. 12, 1991

[54] MICROWAVE TRANSITION

[75] Inventor: Leonard L. Blaisdell, Medway, Mass.

[73] Assignee: GTE Government Systems Corporation, Waltham, Mass.

[21] Appl. No.: 459,005

[22] Filed: Dec. 29, 1989

[51] Int. Cl.[5] ..... H01Q 19/060; H01Q 15/080

[52] U.S. Cl. ..... 343/753; 333/240; 343/911 R

[58] Field of Search ..... 333/237, 240; 343/785, 343/786, 908, 911 R, 753, 754

[56] References Cited

U.S. PATENT DOCUMENTS 4,536,767 8/1985 Rembold et al. ..... 343/785

FOREIGN PATENT DOCUMENTS 1917675 10/1970 Fed. Rep. of Germany ..... 343/785

1205378 8/1959 France ..... 343/753

*Primary Examiner*—Rolf Hille

*Assistant Examiner*—Peter Toby Brown

*Attorney, Agent, or Firm*—J. Stephen Yeo

[57] ABSTRACT

A transition includes a sheet of dielectric material having two parallel surfaces. A tapered recess in one surface converges towards the other surface with the axis of the recess orthogonal to said surface. The dielectric material has a critical angle of reflection with respect to the axis.

A RF horn is located in proximity to the surface with the recess and has an axis in common with the axis of the tapered recess. A RF lens is located between the horn and the tapered recess. The optical properties of the RF horn, RF lens, tapered recess, and dielectric material are such that all rays traced from the horn through the lens and dielectric material to the second surface have an angle with respect to said normal of the second surface greater than said critical angle. RF energy on the second surface from the center of the horn is in phase with RF energy on said second surface from the edge of said horn allowing a surface wave to be launched on the second surface.

2 Claims, 3 Drawing Sheets

1. $\theta_t' = \tan^{-1} t/x_1$

2. $\sin\theta' = \sqrt{e_{r'}}\ \sin\theta_t'$

3. $\theta_1 = 180 - \phi - \theta_t$

4. $\theta = 180 - \phi - (\theta' - \theta_t')$

5. $b = b' + b''$ $$b' = \frac{\sin(\theta' - \theta_t')\left[L - \ell_n - x_n \tan(180-\phi)\right]}{\sin\theta + 90}$$

$$b'' = \frac{x_n}{(\cos\ 180-\phi)}$$

6. $\cos(180-\phi) = c/b$

7. $\tan(180-\phi) = a/c$

8. $\tan\theta_1 = \dfrac{d}{a + .189}$

9. $R_6 = c + d$

10. $\ell_n = x_n \tan\theta_{t'}$

11. $\dfrac{\ell n'}{\sin(\phi - 90)} = \dfrac{L'}{\sin B}$ $B = \theta + 90$ $L' = L - \ell n - xn\ \tan(180-\phi)$ 12. $\sin\theta_1 = \dfrac{d}{\ell n''}$

13. PHASE CRITERION $\ell_1 + \ell_1 + \ell_1'' = \ell n + \ell' n + \ell'' n + \Delta\phi n$ $$\Delta\lambda\phi_n = \frac{R_{61} - R_{6n}}{\lambda x} \times 360$$

$\lambda_x = \lambda$ OF SURFACE WAVE $$\theta_1 > \theta_c = \sin^{-1}\frac{1}{\sqrt{e_{r'}}}$$

NOTE: $X_1 = \bullet\dfrac{377}{2}$ FOR EDGE RAY $X_1$ IS HORN APERTURE RADIUS

FIG. 2B

MICROWAVE TRANSITION

RELATED COPENDING PATENT APPLICATIONS

U.S. patent application Ser. No. 495,004 filed with this by the same applicant for MICROWAVE ANTENNA is concerned with an antenna incorporating the transition of the present invention.

BACKGROUND OF THE INVENTION

This invention pertains to microwave transitions, and more particularly is concerned with microwave transitions for exciting planar surface waves.

Many communication systems require a flat, planar, low profile aperture antenna that can be easily conformed to an existing structure such as the skin of an aircraft, or concealed in a flat surface as required in covert communication system applications. In the past, monolithic microwave integrated circuit (MMIC) phased arrays have been used for such applications because they provide a low profile aperture. The usual reasons for using a phased array such as high speed beam scanning and multi-beam/multi-function requirements do not exist in these applications.

There are two major disadvantages to a phased array technique for such applications: it is very costly since the amplitude and phase at each point in the aperture is controlled discreetly; and the upper frequency limitation of the MMIC phased array technology is unacceptable for communication systems in which the need for greater bandwidths required operation in the submillimeter bands.

Classical surface (slow wave) and leaky (normally fast wave) antenna structures are end fed, typically, by a microwave horn. Planar (two-dimensional) apertures are constructed by physically paralleling individual one dimensional travelling wave elements. They have several disadvantages: the antenna beam is normally in or close to the end-fire direction; the beam direction scans with frequency: and, horn launchers radiate directly resulting in degraded lossy antenna pattern characteristics.

It is desirable to provide an improved transition for exciting a radial RF surface wave on a surface of a sheet of dielectric material.

SUMMARY OF THE INVENTION

Briefly, an transition includes a sheet of dielectric material having two parallel surfaces. A tapered recess in one surface converges towards the other surface with the axis of the recess orthogonal to both surfaces. The dielectric material has a critical angle of reflection with respect to the axis. A RF horn is located in proximity to the surface with the recess and has an axis in common with the axis of the tapered recess. A RF lens is located between the horn and the tapered recess. The optical properties of the RF horn, RF lens, tapered recess, and dielectric material are such that all rays traced from the horn through the lens and dielectric material to the second surface have an angle with respect to said normal of the second surface greater than said critical angle. RF energy on the second surface from the center of the horn is in phase with RF energy on said second surface from the edge of said horn allowing a surface wave to be launched on the second surface.

DETAILED DESCRIPTION

As a feature of the invention, a launcher excites a radially travelling surface wave which spreads energy over a dielectric disk. Perturbations cause the surface to leak in a controlled manner to produce a radiating aperture with a desired illumination characteristic.

By exciting a surface wave at the center of a dielectric sheet, all three of the problems associated with the classical surface wave antenna are eliminated. Every point to the right of center has a corresponding point to the left which has the same amplitude and phase (relative to the center of the aperture) and every point above has a corresponding point below with the same this amplitude and phase in the radially travelling surface wave. An inherently broadside beam which does not frequency scan is radiated by the aperture. By proper design, spillover from the launcher horn is controlled to minimize or eliminate its effects upon antenna pattern characteristics.

Figure 1:
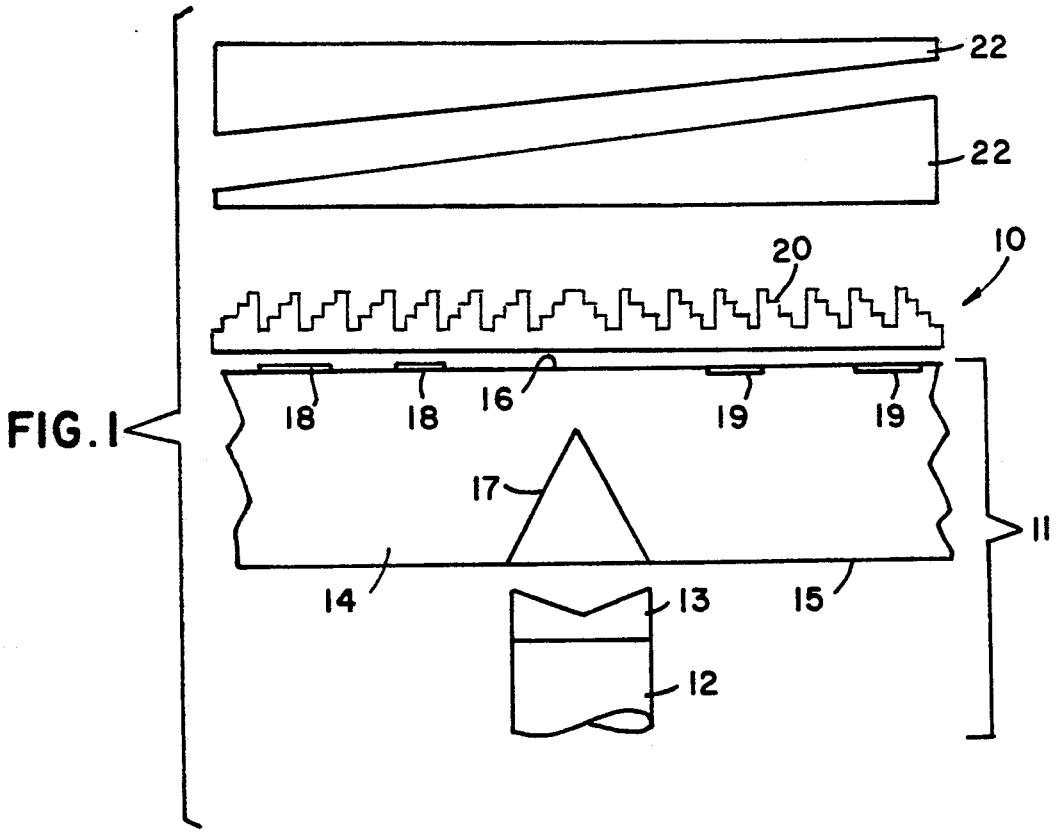
FIG. 1 shows, in cross section, a transition embodying the invention and an antenna incorporating the transition.

FIG. 1 shows in cross section a surface wave launcher or transition 11 embodying the invention and a antenna 10 incorporating the transition. The transition includes a RF feed horn 12, an input lens 13, and a sheet of dielectric material 14. The sheet of dielectric material 14 has a first surface 15 (backside) and a parallel second surface 16 (front) and may be disk shaped. The first surface 15 is in proximity to RF feed horn 12. The second surface 16 supports the surface wave, and when perturbed beyond the launching region radiates RF energy. Tapered recess 17 converges from the first surface 15 towards the second surface 16. The recess 17 has an axis normal to the second surface 16. Feed horn 12 is preferably a $TE_{11}$/ $TM_{11}$ multimode conical horn having radiation characteristics of E and H-plane symmetry. The horn may have typically a 12.5dB taper, which is a tradeoff between launcher region blocking loss and horn spillover loss. Lens 13 and sheet 14 may be made of commercially available dielectric material such as sold under the trademarks Noryl and Lexan.

The input lens 13 is interposed between the horn 12 and the tapered recess 17. The input lens 13 may be disk shaped with a conical relief in its output side. The lens 13 bends the rays away from the horn axis, and may be designed so that the rays between the lens 13 and the tapered recess 17 are parallel to each other.

The feed horn 12 has an axis aligned with the axis of the tapered recess 17, which may also be the center line of the sheet 14 if the sheet is disk shaped. The tapered recess 17 is conical if the lens 13 is designed so that the rays entering the tapered recess 17 are parallel.

The dielectric material has a critical angle of reflection with respect to the normal of the second surface. All RF energy incident to the second surface at or greater than the critical angle will be reflected. The critical angle is a function of the relative dielectric constant of the material. For a relative dielectric constant of 2.75, the critical angle is 37.1 degrees.

Figure 2A:
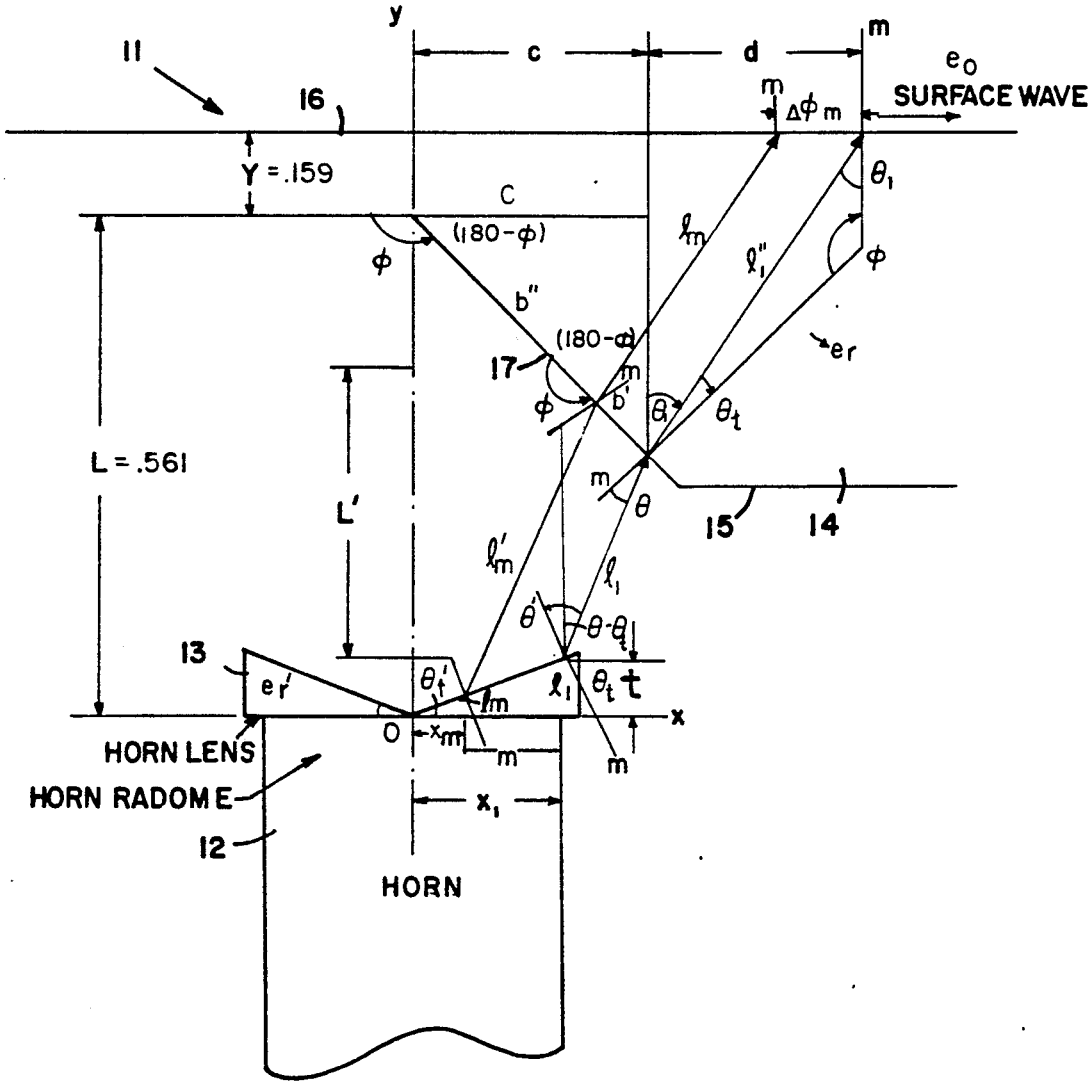
FIG. 2A and B illustrates certain design considerations of the transition of FIG. 1.

The feed horn 12, input lens 13, tapered recess 17, and sheet 14 have RF physical properties such that: 1) all rays emitting from the horn through the input lens and recess to the second surface have an angle $\theta_1$ with respect to the normal of the second surface greater than the critical angle $\theta_c$; and 2) RF energy from the center of the horn is in phase with RF energy from the edge of the horn for launching a radial surface wave on the second surface of the sheet of dielectric material. Design equations to meet these criteria are shown in FIG. 2.

At a frequency of 47 Ghz, the wavelength of the surface wave is about 0.2358 inches. The dielectric sheet may be a disk 12 inches in diameter.

Perturbations at the second surface 16 beyond the launching region cause the surface wave to leak producing a radiating aperture with a desired illumination characteristic. The perturbing means can be a plurality of conductive disks 18 printed on the second surface 16 or a plurality of holes 19 or other perturbations arranged in the second surface 16. The size of the perturbations may increase with distance from the launch region to control the effective illumination distribution across the radiating aperture.

Figure 3:
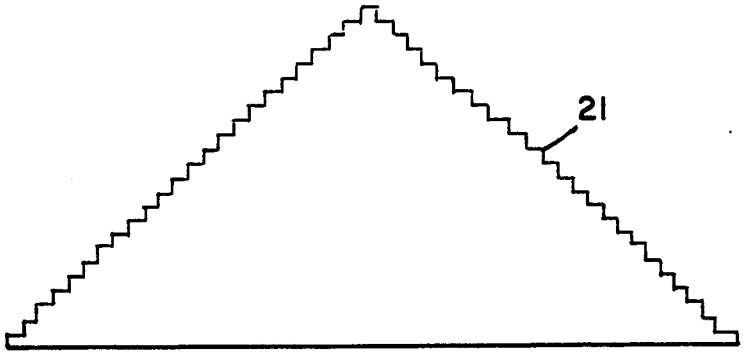
FIG. 3 show a time delay lens for the antenna.

An output lens 20 on the second surface 16 corrects for phase shifts across the second surface. The output lens 20 may be a phase delay lens as shown in FIG. 1, or a time delay lens 21 as shown in FIG. 3. A suitable time delay lens 21 may be made of quartz with a height of 6.85 inches and a diameter of 12 inches at 47 Ghz. Steps are provided each 45 electrical degrees (0.030 inches at 47 Ghz) typically, to assure that energy incident upon the lens output surface does not exceed the critical angle. Phase delay lens 20 is similar to the time delay lens 21 except the lens outer surface is stepped back each 360 degrees towards the lens' input surface to reduce height.

A pair of dielectric wedges 22 may be used as seen in FIG. 1 to provide scanning capability to the antenna.

The preferred embodiment of a transition for exciting a radial RF surface wave on a surface of a sheet of dielectric material has been described. Various modifications will now be apparent to those skilled in the art yet remain in the scope of the claims.

What is claimed is:

1. A transition for exciting a radial RF surface wave on a surface of a sheet of dielectric material comprising:

a sheet of dielectric material having a first surface and a parallel second surface;

a tapered recess in said dielectric material converging from said first surface towards said second surface and having an axis normal to said second surface; said dielectric material having a critical angle of reflection with respect to the normal of said second surface;

a RF horn arranged nearer to said first surface than said second surface and having an axis in common with the axis of said tapered recess; and a RF lens interposed between said horn and said tapered recess; said RF horn, RF lens, tapered recess, and dielectric material having RF optical properties such that all rays traced from said horn through said lens and dielectric material to said second surface have an angle with respect to said normal of said second surface greater than said critical angle and RF energy on said second surface from the center of said horn is in phase with RF energy on said second surface from the edge of said horn for launching a surface wave on said second surface.

2. The transition of claim 1 wherein rays between said lens and said tapered recess are parallel to each other and said tapered recess is conical.

* * * * *